US006374559B1

(12) United States Patent
Rutherford

(10) Patent No.: US 6,374,559 B1
(45) Date of Patent: Apr. 23, 2002

(54) SEALED EXPANSION JOINT

(75) Inventor: Barry Rutherford, Chatsworth, CA (US)

(73) Assignee: Flannery, Inc., San Fernando, CA (US)

( * ) Notice: Subject to any disclaimer, the term of this patent is extended or adjusted under 35 U.S.C. 154(b) by 0 days.

(21) Appl. No.: 09/267,424

(22) Filed: Mar. 12, 1999

(51) Int. Cl.[7] ..... E04B 1/68
(52) U.S. Cl. ..... 52/393; 52/588.1
(58) Field of Search ..... 52/393, 589.1, 52/394, 395, 519, 520, 345, 588.1

(56) References Cited

U.S. PATENT DOCUMENTS

| | | | |
|---|---|---|---|
| 2,904,992 | A | 9/1959 | Cruser |
| 3,015,194 | A | 1/1962 | Clark |
| 3,323,269 | A | 6/1967 | Widdowson |
| 3,331,176 | A | 7/1967 | Washam |
| 3,417,528 | A | 12/1968 | Hallock |
| 3,765,138 | A | 10/1973 | Bentle |
| 4,107,892 | A | 8/1978 | Bellem |
| 4,651,488 | A | 3/1987 | Nicholas et al. |
| 4,785,601 | A | 11/1988 | Tupman |

*Primary Examiner*—Beth A. Stephan
(74) *Attorney, Agent, or Firm*—Christie, Parker & Hale, LLP

(57) ABSTRACT

Sealed expansion joints comprise first and second joint members each having a backside surface adapted for installation against a planar surface. The first joint member further comprises at least one angular surface section that is designed to facilitate moisture passage thereover when installed onto an underlying wall structure. The first joint member also includes a groove disposed therein between the backside and frontside surfaces. The second joint member is positioned adjacent the first joint member, e.g., either below the first joint member or to the side of the first joint member, and includes an outwardly projecting tongue that extends towards first joint member. The tongue is disposed a desired depth into the groove. Together, the first and second joint members form a channel that extends therebetween. A sealing member is disposed within the groove and is interposed between the tongue and the groove. The sealing member is attached to the tongue to move slidably with the tongue in the groove to provide a leak-tight seal between the first and second joint members.

10 Claims, 3 Drawing Sheets

SEALED EXPANSION JOINT

FIELD OF THE INVENTION

This invention relates to expansion joints and reveals used in exterior/interior wall constructions to enable wall material expansion and contraction and, more particularly, to expansion joints and reveals that are sealable to prevent water intrusion behind the wall material.

BACKGROUND OF THE INVENTION

The use of expansion joints and reveals in exterior/interior wall constructions to accommodate wall material expansion and contraction are known. Such conventional expansion joints and reveals typically comprise two joint members that are each installed over a wall supporting structure, e.g., over a wooden structure covered with waterproof paper. When used in a horizontal application the members are positioned vertically with respect to one another, creating a channel that runs horizontally across the wall structure surface. The channel is formed between the joint or reveal members and the outer wall material. Each joint member includes a flange that projects outwardly away from the wall and the joint member portion that is attached to the wall structure.

One of the joint members is designed having a bridging section that extends to and is movably connected with the other joint member. An outer wall material, e.g., stucco, plaster and the like, is disposed over the wall structure and to the joint member flanges, leaving the channel uncovered. Designed in this manner, conventional expansion joints and reveals permit expansion and contraction movement of the outer wall material by cooperative movement of the joint members about the bridging section.

When used in such horizontal applications, water or moisture that accumulates on the outer wall material surface runs by gravity to the expansion joint. Such conventional expansion joints are not, however, designed to prevent the buildup of water or moisture between the expansion joint member and a backside surface of the outer wall material. Further, such conventional expansion joints are also not designed to prevent water or moisture from passing between the two expansion joint members to the underlying wall structure. The passage of water or moisture to the backside surface of the outer wall material and/or to the underlying wall structure is not desired because it can eventually cause substantial damage to the outer wall material and/or the wall structure.

U.S. Pat. No. 4,785,601 discloses a plaster control screed that is configured in the manner described above, comprising two companion members that are each attached along respective base portions to an underlying wall structure. The companion members are positioned vertically adjacent one another, and each includes a channel side that projects perpendicularly outwardly away from a respective base portion to accommodate a thickness of plaster outside wall surface material. A horizontal channel is created between the two vertically-adjacent channel sides to accommodate expansion and contraction wall movement. One of the members includes an extending portion, that projects a distance along the base between the channel sides, into a groove formed in the other member. Together, the extending portion and groove arrangement between the two companion members is intended to enable movement between the members while maintaining contact therebetween. The groove is filled with a sealant to minimize moisture hold up.

The above-described plaster control screed, however, is not configured to prevent the accumulation of moisture or water from the outside wall surface between the members and the backside surface of the outside wall surface. Water or moisture on the outside wall surface is permitted to enter between the channel side and the backside surface of the outside wall surface as it passes downwardly along the wall due to the design of the member channel sides. Additionally, water or moisture that enters behind each member is allowed to pass to the underlaying wall structure, where it can eventually build up and enter the stud cavity at the first building paper layer lap.

Further the use above-described control screed requires a multi-step installation process that time consuming, thus adding to the cost of installing the device. For example, such control screed is installed by a three-step process that comprises: (1) attaching a lower companion member (i.e., the member comprising the extending portion) to the underlying wall structure; (2) installing a bead of sealant into the groove of the other companion member, making sure that the amount of sealant is not too little (permitting moisture to enter between the parts) or too great (permitting the excess to spill onto the exposed companion member and requiring clean up); and (3) installing the remaining companion member by placing the extending portion inside of the groove and attaching the member to the underlying wall structure.

It is, therefore, desired that an expansion joint and reveal be constructed that: (1) permits expansion/contraction of the outer wall material; (2) prevents the buildup of water or moisture between the expansion joint and a backside surface of the outer wall material; (3) prevents the passage of water or moisture between expansion joint members to the underlying wall structure.; and (4) enables time-efficient installation in the field. It is desired that such expansion joint and reveal be easy to install and be formed from readily available materials.

SUMMARY OF THE INVENTION

Sealed expansion joints, constructed according to principles of this invention, comprise first and second joint members each having a backside surface adapted for installation against a planar surface. The first joint member further comprises at least one angular surface section that is designed to facilitate moisture passage thereover when installed onto an underlying wall structure. The first joint member also includes a groove disposed therein between the backside and frontside surfaces.

The second joint member is positioned adjacent the first joint member, e.g., either below the first joint member or to the side of the first joint member, and includes an outwardly projecting tongue that extends towards first joint member. The tongue is disposed a desired depth into the groove. Together, the first and second joint members form a channel that extends therebetween.

A sealing member is disposed within the groove and is interposed between the tongue and the groove. The sealing member is attached to the tongue to move slidably with the tongue in the groove to provide a leak-tight seal between the first and second joint members. Configured in this manner, the coupled first and second joint members form an expansion joint that: (1) enables expansion/contraction wall movement; (2) facilitates moisture travel thereover; and (3) prevents moisture travel from each joint member frontside surface to an underlying wall structure surface.

DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

Expansion joints and reveals of this invention are constructed for use in either horizontal or vertical wall applications and generally comprise first and second joint members that are slidably connected together by a water-tight seal. Expansion joints and reveals of this invention designed for horizontal wall applications additionally comprise an expansion member that is configured to protect against moisture accumulating behind an outer wall material.

Figure 1:
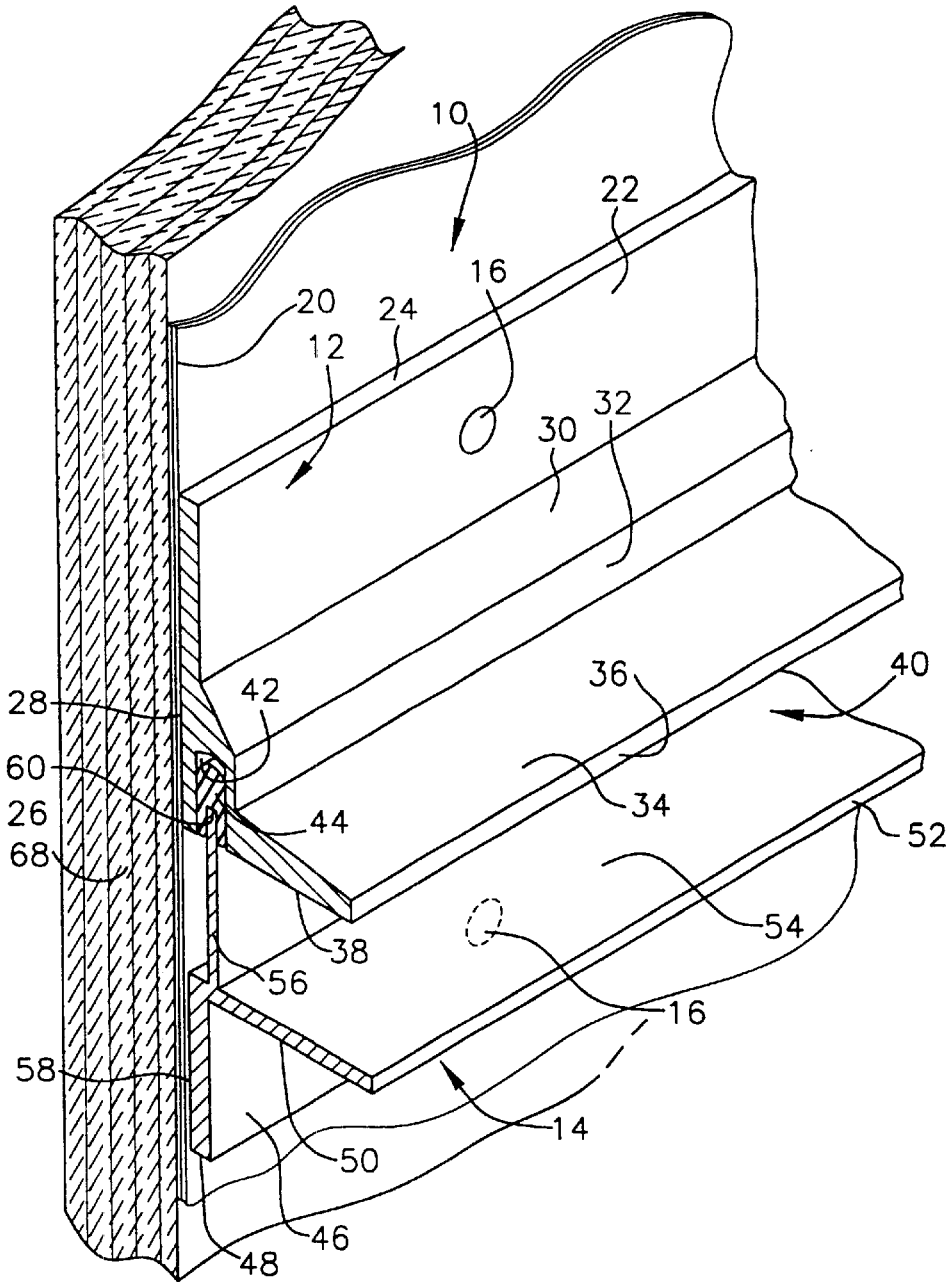
FIG. 1 is perspective view of a first embodiment sealed expansion joint constructed according to principals of this invention.

FIG. 1 illustrates a first embodiment expansion joint 10 that is designed for a horizontal wall application. The expansion joint 10 comprises a first expansion joint member 12 that is installed within a wall structure vertically above a second expansion joint member 14. Each expansion joint member is attached to an underlying wall structure surface. In an exemplary embodiment, each expansion joint member is attached by conventional attachment means 16, such as by nail or screw, to an underlying wall structure comprising a wooden shear 18 that is covered by one or more layers of waterproof building paper 20. The expansion joint members do not include pre-formed holes for accommodating the attachment means, rather holes are formed in the joint member by the attachment means during the attachment process.

Figure 2:
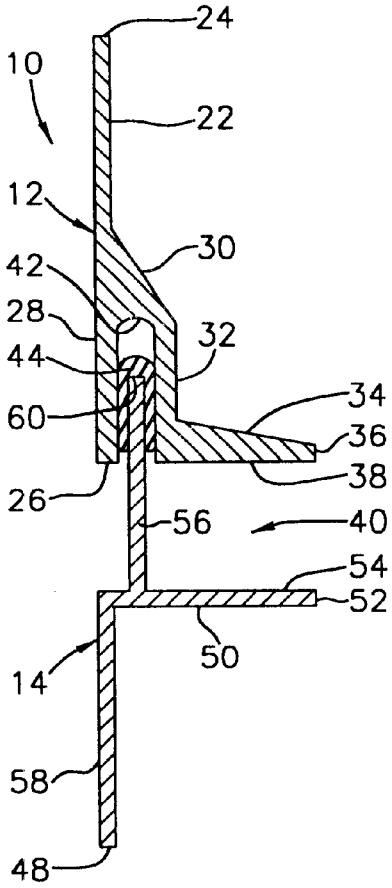
FIG. 2 is a cross-sectional side elevation of the sealed expansion joint of FIG. 1.

Referring to FIGS. 1 and 2, the first expansion joint member 12 comprises a generally flat base 22 that extends vertically downward in FIG. 1 from an upwardly facing end 24 to a downwardly facing end 26, along a backside surface 28 of the joint member disposed against the wall structure. The flat base 22 extends vertically downward along a joint member frontside surface a determined length to a ramped section 30 that projects outwardly downward and away from the base 22 at a determined angle. In an example embodiment, the ramped section 30 extends outwardly downward from an approximate mid point of joint member frontside surface at an angle of approximately 30 degrees. It is important to note that the ramp angle can vary depending on particular application. The ramped section 30 is designed to enable the gravity passage moisture trapped behind an outer wall material downwardly over the first joint member as better described below.

The ramped section 30 extends a length to a flat section 32 that is substantially planar with the base 22. The flat section 32 extends vertically downward a distance to a first expansion joint member flange 34 The flange 34 extends outwardly downward and away from the flat section 32 at a determined angle to a flange terminal edge 36. In an example embodiment, the flange 34 projects outwardly at an angle of approximately 60 degrees as measured from the flat section 32. In such example embodiment the vertical distance between the upwardly facing end 24 and the junction between the flat section 32 and flange 34 is approximately two inches Like the ramped section 30 described above, it is important to note that flange angle can vary depending on particular application. The flange 34 is designed to enable the gravity passage moisture trapped behind an outer wall material downwardly over the first joint member and to exterior outer wall surface as better described below.

A flat wall section 38 extends inwardly away from the first expansion joint member flange terminal end 36 a distance towards the first joint member backside surface 28, and is coterminous with the downwardly facing end 26. The flat wall section 38 is perpendicular to both the base 22 and flat section 32, and defines an upper wall surface of a channel 40 that is formed between the first and second expansion joint members. A groove 42 is disposed within the flat wall section 38 and extends vertically upwardly a depth into the first expansion joint member. The groove 42 runs horizontally along the length of the first expansion joint member and forms a sealing chamber therein. In an example embodiment, the groove has a depth that is approximately coterminous with the junction point between the ramped and flat section 30 and 32, respectively. As will be explained below, groove is configured having a sufficient depth to both accommodate placement of a sealing member 44 completely therein and permit a desired degree of vertical sealing member movement therein. The groove has a sufficient width to accommodate placement of the sealing member 44 and provide a leak-tight seal therewith.

It is to be understood that the particular groove 42 depth can vary from application to application, and is primarily determined by the amount of relative movement that is anticipated between adjacent first and second expansion joint members. For example, it is desired that the groove be deeper for expansion joint applications where a large degree of expansion/contraction movement is known to occur, than for expansion joint applications where little or relatively less expansion/contraction movement is known to occur.

Moving vertically upward in FIG. 1 towards the first expansion joint member, the second expansion joint member 14 comprises a generally flat base 46 that extends vertically upward along a frontside surface of the second joint member a determined length from a downwardly facing end 48. The flat base 46 extends vertically upward to a ridge 50 that extends outwardly a distance away from the flat base 46 at an angle of approximately 90 degrees. The ridge 50 extends outwardly to form a terminal edge 52 that is coplanar with the terminal edge 36 of the first expansion joint member. The ridge 50 includes an upwardly facing wall section 54 that is directed towards the wall section 38 of the first joint member, and that forms a bottom wall surface of the channel 40 that extends between the first and second joint members. In an example embodiment, the vertical distance between the end 48 and the ridge 50 is approximately ⅞ inch.

A tongue 56 projects vertically upwardly away from the ridge 50 from a position near and offset from a backside surface 58 of the second expansion joint member 14. The tongue 56 is positioned along the ridge so that it is in cooperating relation with the first joint member groove 42 to be accommodated therein. The tongue 56 extends vertically a sufficient distance so that a tongue end 60 is disposed completely within the groove. It is to be understood that the length of the tongue 56 will vary for the reasons discuss above with respect to the depth of the first joint member groove 42.

A sealing member 44 is disposed onto the tongue end 60 and is interposed between the tongue and adjacent groove 42 wall surfaces. The sealing member can be in the form of an elastomeric element that is adapted to: (1) fit over the tongue end 60 to provide a leak-tight, i.e., water-tight, seal therebetween; (2) provide an outside structure having surfaces that fit within the groove and form a leak-tight seal threragainst; and (3) permit vertical movement of the sealing member and/or tongue within the groove without compromising such leak-tight seals. In an example embodiment, the sealing member 44 is in the form of a gasket that is formed from a rubber material, the gasket having a C-shaped cross section with the tongue end disposed within a gasket central cavity, and with opposed outside gasket wall disposed against adjacent groove wall surfaces. The sealing member 44 constructed in this manner provides a leak-tight seal with both the tongue and the groove to prevent the passage of water or moisture from the outside environment past the first and second expansion joint member and to the underlying wall structure surface. The sealing member 44 performs in such manner while at the same time permitting expansion and contraction movement of the coupled joint members.

A feature of expansion joints constructed according to principles of this invention is the construction of the first joint member 12 that has an outside surface designed to facilitate gravity flow of water or moisture downwardly therealong and away from the underlying wall structure, rather than providing a moisture trap or facilitating the passage of moisture to the underlying wall structure. Thus, this design protects the underling wall structure from undesired moisture-related damage.

Another feature of expansion joints constructed according to principles of this invention is the design of the joint member coupling tongue and groove and sealing member to provide a leak-tight seal between coupled joint members while enabling reciprocating movement between the coupled joint members. Constructed in this manner, expansion joints of this invention facilitate coupled joint member expansion/contraction movement while protecting the underlaying wall structure from unwanted damage caused by water or moisture passage from the outside environment.

A still other feature of expansion joints constructed according to principles of this invention is that they are easily and quickly installed in the field. Unlike the plaster screed disclosed in U.S. Pat. No. 4,785,601 that requires a three-step installation process, expansion joints of this invention are factory assembled, enabling their installation in the field by one simple step of attaching the combined assembly to the underlying wall structure surface. It is estimated that, for this reason, use of the expansion joint of this invention can reduce installation time and related installation cost by approximately ⅓ when compared to the above-described plaster screed.

While an expansion joint comprising coupled first and second joint members has been described above and illustrated, it is to be understood one or both joint members can be used to take advantage of one or more features noted above. For example, the first joint member described and illustrated above can be used alone in a horizontal wall application along a bottom portion of a wall structure without the second joint member. In such application, i.e., serving as a weeping drip screed, the first joint member serves the designed function of facilitating moisture passage over its outside surface and away from the underlying wall structure.

Figure 3:
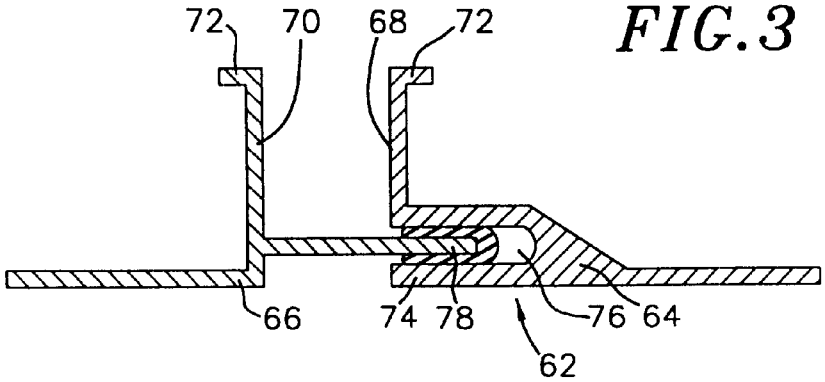
FIG. 3 is a cross-sectional side elevation of a second embodiment sealed expansion joint of this invention.

FIG. 3 illustrates a second embodiment expansion joint 62 of this invention comprising first and second expansion joint members 64 and 66, respectively. The Expansion joint 62 is similar to that described above and illustrated in FIGS. 1 and 2 except that the first and second joint members each include walls 68 and 70, respectively, that each project outwardly away from and perpendicular to the respective joint member. The walls 68 and 70 are each designed having a lip 72 that, together with the respective wall, acts to retain an outer wall construction material, e.g., stucco, therebehind. The second embodiment expansion joint 62 comprises a sealing member 74 disposed within a first joint member groove 76 and interposed between the groove 76 and a second joint member tongue 78.

Figure 4:
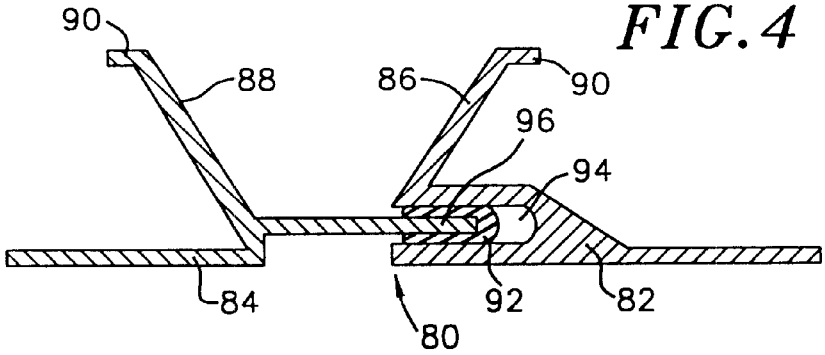
FIG. 4 is a cross-sectional side elevation of a third embodiment sealed expansion joint of this invention.

FIG. 4 illustrates a third embodiment expansion joint 80 of this invention comprising first and second expansion joint members 82 and 84, respectively. The Expansion joint 80 is similar to that described above and illustrated in FIGS. 1 and 2 except that the first and second joint members each include walls 86 and 88, respectively, that each project outwardly away from the respective joint member. Unlike the second embodiment, however, the walls 86 and 88 project outwardly at an angle less than 90 degrees to the respective joint member. In an example third embodiment, the walls 86 and 88 each project outwardly at an angle of approximately 45 degrees towards the respective joint member. The walls 86 and 88 are each designed having a lip 90 that, together with the respective wall, acts to retain an outer wall construction material, e.g., stucco, therebehind. The third embodiment expansion joint 80 comprises a sealing member 92 disposed within a first joint member groove 94 and interposed between the groove 94 and a second joint member tongue 96.

Figure 5:
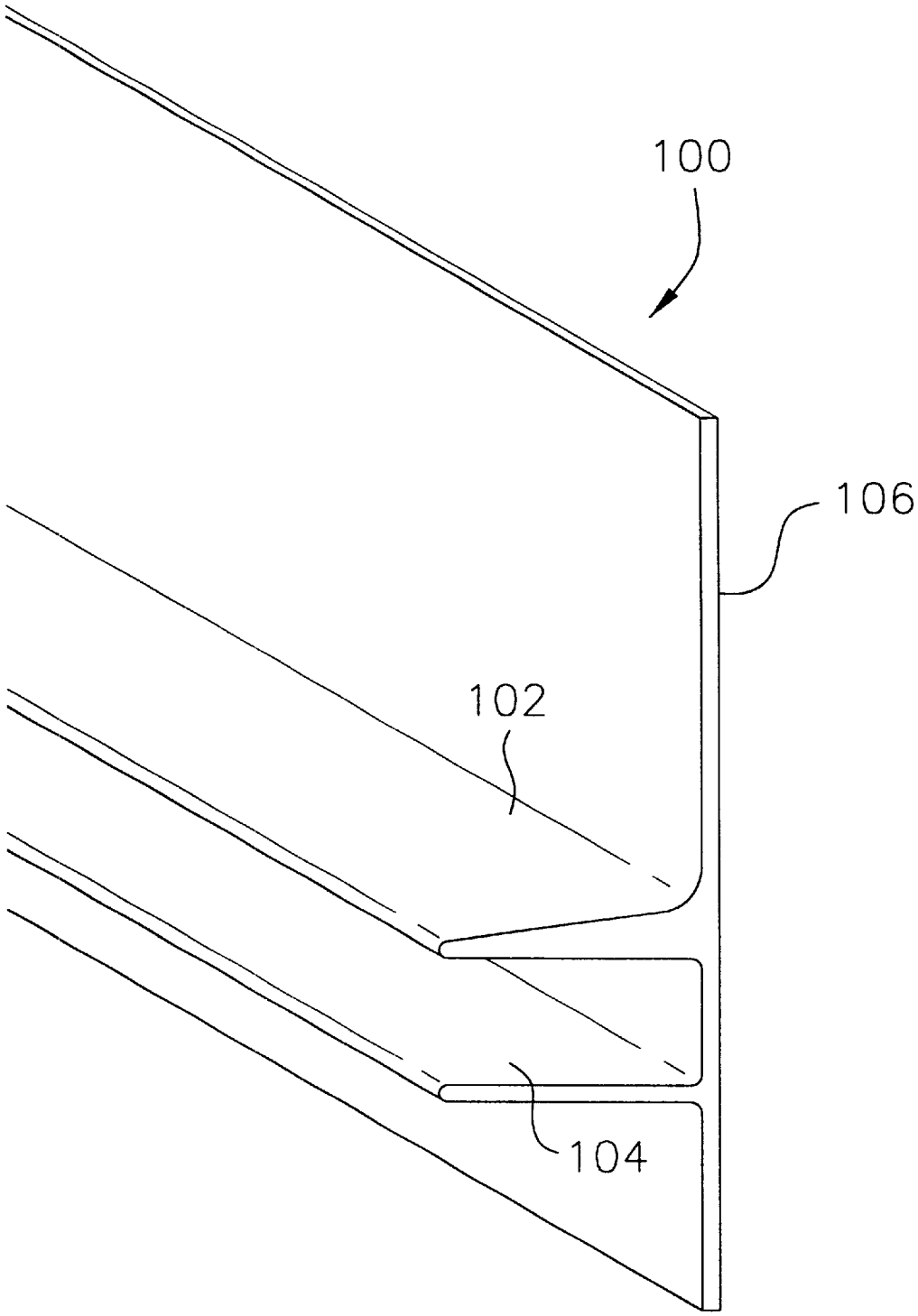
FIG. 5 is a perspective view of a one-piece expansion joint constructed according to principles of this invention.

FIG. 5 illustrates a one-piece embodiment of the expansion joint 100 that is configured having the same general structure as the expansion joint described above and illustrated in FIGS. 1 and 2 except that the two flanges 102 and 104 are stationary relative to one another and are not attached to movable joint members. More specifically, the one-piece expansion joint 100 comprises a generally flat or planar base 106 that extends between and is common to the two flanges 102 and 104. The flange 102 is configured in the same general manner as the flange 34 of the first expansion joint embodiment, comprising a ramped top surface to facilitate the passage of moisture or water downwardly and outwardly away from the flange and the base 106. In this manner, the one-piece expansion joint 100 serves to prevent moisture build up underneath the outside wall surface material. The one-piece expansion joint 100 is intended to be used in applications where expansion and contraction wall movement is not a concern. Examples applications include wall applications where a continuous wall channel and moisture protection, provided by the above-described multipiece expansion joint, is aesthetically desired, yet expansion and contraction wall movement is not a concern.

Although limited embodiments of sealed expansion joints have been specifically described and illustrated herein, and specific dimensions have been disclosed, many modifications and variations will be apparent to those skilled in the art. Accordingly, it is to be understood that, within the scope of the appended claims, sealed expansion joints according to principles of this invention may be embodied other than as specifically described herein.

What is claimed is:

1. An expansion joint comprising:

a first joint member having a backside surface adapted for installation against a planar surface, a frontside surface comprising angular surface sections to facilitate moisture passage thereover, and a groove disposed within the first joint member between the backside and frontside surfaces;

a second joint member positioned adjacent the first joint member, wherein the second joint member has a backside surface adapted for installation against a planar surface, and has an outwardly projecting tongue that extends away from the second joint member towards the first joint member, and wherein the tongue is disposed a depth into the groove; and a sealing member attached to a terminal end of the tongue, wherein the attached tongue and sealing member together move slidably within the groove to provide a leak-tight seal between the first and second joint members.

2. The expansion joint as recited in claim 1 wherein the groove extends within the first joint member in a direction parallel with the first joint member backside surface.

3. The expansion joint as recited in claim 1 wherein the tongue extends away from the second joint member in a direction parallel to the second joint member backside surface.

4. The expansion joint as recited in claim 1 wherein the sealing member is in the form of a C-shaped gasket made from a an elastomeric material.

5. The expansion joint as recited in claim 1 wherein the first and second joint members each include wall sections that extend outwardly away from respective frontside surfaces, and wherein the wall sections and the tongue together define a channel extending between the first and second joint members.

6. An expansion joint comprising:

a first joint member having a body with;

a backside surface adapted for installation against a planar surface;

a frontside surface comprising angular surface sections for accommodating moisture passage thereover;

a wall section extending outwardly away from the frontside surface; and a groove disposed within the body between the backside and frontside surfaces;

a second joint member positioned adjacent the first joint member, wherein the second joint member has a body with:

a backside surface adapted for installation against a planar surface;

a wall section extending outwardly away from the second joint member body frontside surface and parallel with the wall section of the first joint member; and a tongue that projects outwardly away from the second joint member towards the first joint member, wherein the tongue is disposed a depth into the groove;

a channel disposed between the first and second joint members defined by the first and second joint member wall sections and the tongue; and a sealing member attached to a terminal end of the tongue, wherein the attached tongue and sealing member together move slidably within the groove to provide a leak-tight seal between the first and second joint members.

7. The expansion joint as recited in claim 6 wherein the sealing member is in the form of a gasket made from an elastomeric material.

8. The expansion joint as recited in claim 6 wherein the groove extends within the first joint member body in a direction parallel with the first joint member backside surface.

9. The expansion joint as recited in claim 6 wherein the tongue extends away from the second joint member in a direction parallel to the second joint member backside surface, and wherein the tongue is offset from the second joint member backside surface.

10. An expansion joint comprising:

a first joint member having a body with:

a backside surface adapted for installation against a planar surface;

a frontside surface adapted for accommodating placement of a wall material thereon and comprising at least one downwardly directed angular surface section for accommodating moisture passage thereover;

a wall section extending outwardly away from the frontside surface; and a groove disposed upwardly within the body between the backside and frontside surfaces;

a second joint member positioned vertically below the first joint member, wherein the second joint member has a body with:

a backside surface adapted for installation against a planar surface and a frontside surface adapted for accommodating placement of a wall material thereon;

a wall section extending outwardly away from the second joint member body frontside surface; and a tongue that projects outwardly away from the second joint member and upwardly towards the first joint member, wherein the tongue is disposed a depth into the groove;

a channel disposed between the first and second joint members defined by the first and second joint member wall sections and the tongue; and a sealing member attached to a terminal end of the tongue, wherein the attached tongue and sealing member together move sidably within the groove to provide a leak-tight seal between the first and second joint members.

* * * * *